United States Patent [19]

Tedei

[11] 4,110,850

[45] Sep. 5, 1978

[54] FLUSH VALVE ASSEMBLY

[76] Inventor: Thomas C. Tedei, 3015 Rose St., Franklin Park, Ill. 60131

[21] Appl. No.: 817,721

[22] Filed: Jul. 21, 1977

[51] Int. Cl.[2] ..... E03D 1/34; E03D 5/02; A61B 19/00

[52] U.S. Cl. ..... 4/326

[58] Field of Search ..... 4/67 A, 34, 52, 57 P, 4/57 R, 67 R

[56] References Cited

U.S. PATENT DOCUMENTS

| | | | |
|---|---|---|---|
| 2,731,647 | 1/1956 | Groth et al. | 4/67 A |
| 3,758,893 | 9/1973 | Smolinski et al. | 4/67 A |
| 3,768,103 | 10/1973 | Robinson | 4/67 A |
| 3,795,016 | 3/1974 | Eastman | 4/67 A |
| 3,909,856 | 10/1975 | Dunn, Jr. | 4/67 A |
| 4,011,604 | 3/1977 | Goldworthy | 4/34 |
| 4,042,982 | 8/1977 | Contreras | 4/67 A |

*Primary Examiner*—Henry K. Artis
*Attorney, Agent, or Firm*—Frank R. Thienpont

[57] ABSTRACT

A flush valve assembly for a toilet tank including a valve body having a plurality of valve controlled inlets, bracket means for connecting the valve body to an overflow pipe in a toilet tank, said valve body being adjustable in said bracket means and said flush valve assembly being easily brought into sealed relationship with the drain valve connected to the drain pipe leading from the toilet tank.

8 Claims, 9 Drawing Figures

Fig. 5.
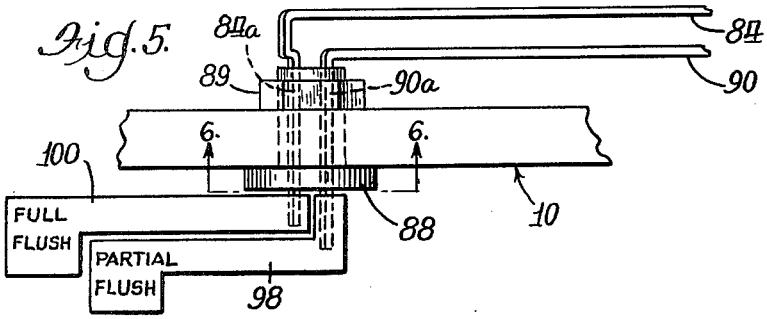
Fig. 6.
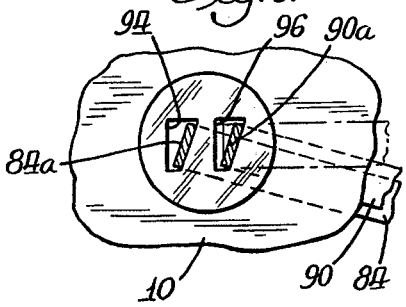
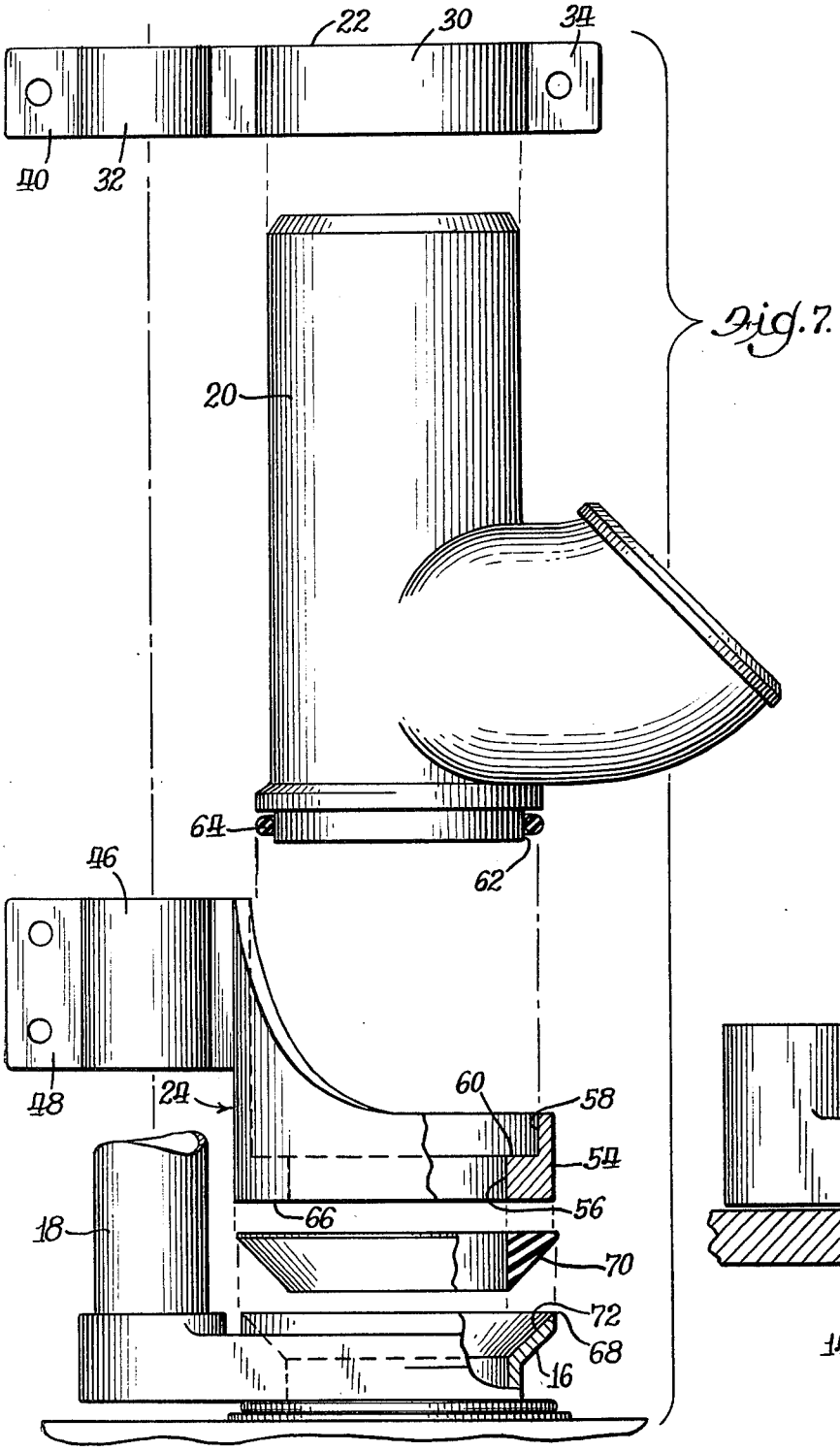
Fig. 7.
Fig. 9.
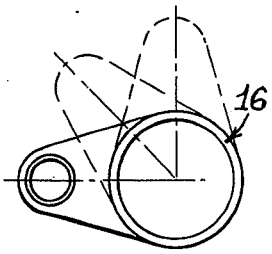
Fig. 8.
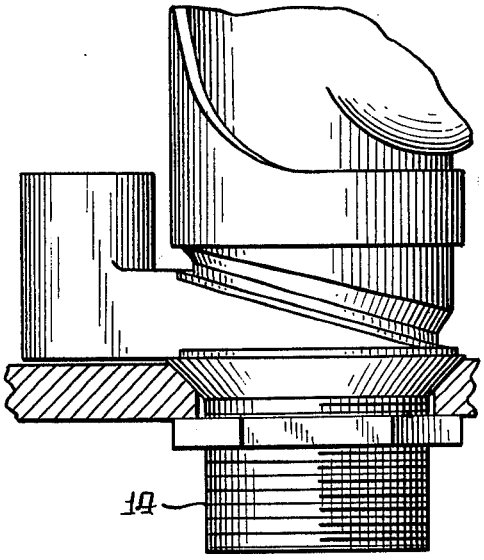

FLUSH VALVE ASSEMBLY

This invention relates to toilet tank flush valve assemblies.

In recent years the problem of excessive use of water has become more and more acute. Statistics bear out that a large percentage of day to day use of water occurs in the family home and in particular in the bathroom. Various devices, including dual flush valves, have been suggested for limiting the use of water in toilet flush tanks. While a great many of these devices are designed to perform a water-saving function, they usually are difficult to install. In fact, they usually require the services of a plumber if they are to be put into an already existing installation. As is well known, plumber serves are tremendously expensive, and this alone is a deterrent even to many well-meaning and cooperative members of the public who may be interested in the conservation of water. Therefore, it has become advisable to create, if possible, a flush valve assembly which may be easily installed by the average person without the necessity of seeking professional plumber help.

SUMMARY OF THE INVENTION

Accordingly, it is a principal object of this invention to provide a dual flush valve assembly which can be installed easily in existing toilet tank facilities.

Another object is to provide a flush valve assembly which may be installed without the necessity of using special tools and the necessity of seeking professional plumber services.

Another object is to provide an easily installable flush valve assembly the position of which can be adjusted depending on the position of the drain valve.

A still further object of the invention is to provide a flush valve assembly in which parts can easily be replaced.

Other objects and advantages will become more apparent when considering the following description and accompanying drawings.

BRIEF DESCRIPTION OF DRAWINGS

FIG. 5 is a plan view showing dual operating handles attached to the flush tank for operating the flush valve assembly;

FIG. 6 is a view in elevation taken at line 6—6 of FIG. 5;

FIG. 7 is an exploded view of a portion of the dual flush valve arrangement;

FIG. 8 is a partial view in elevation showing a Douglas valve with an inclined seat;

FIG. 9 is a plan view showing different positions of a drain valve in a toilet tank installation.

DESCRIPTION OF PREFERRED EMBODIMENT

Figure 1:
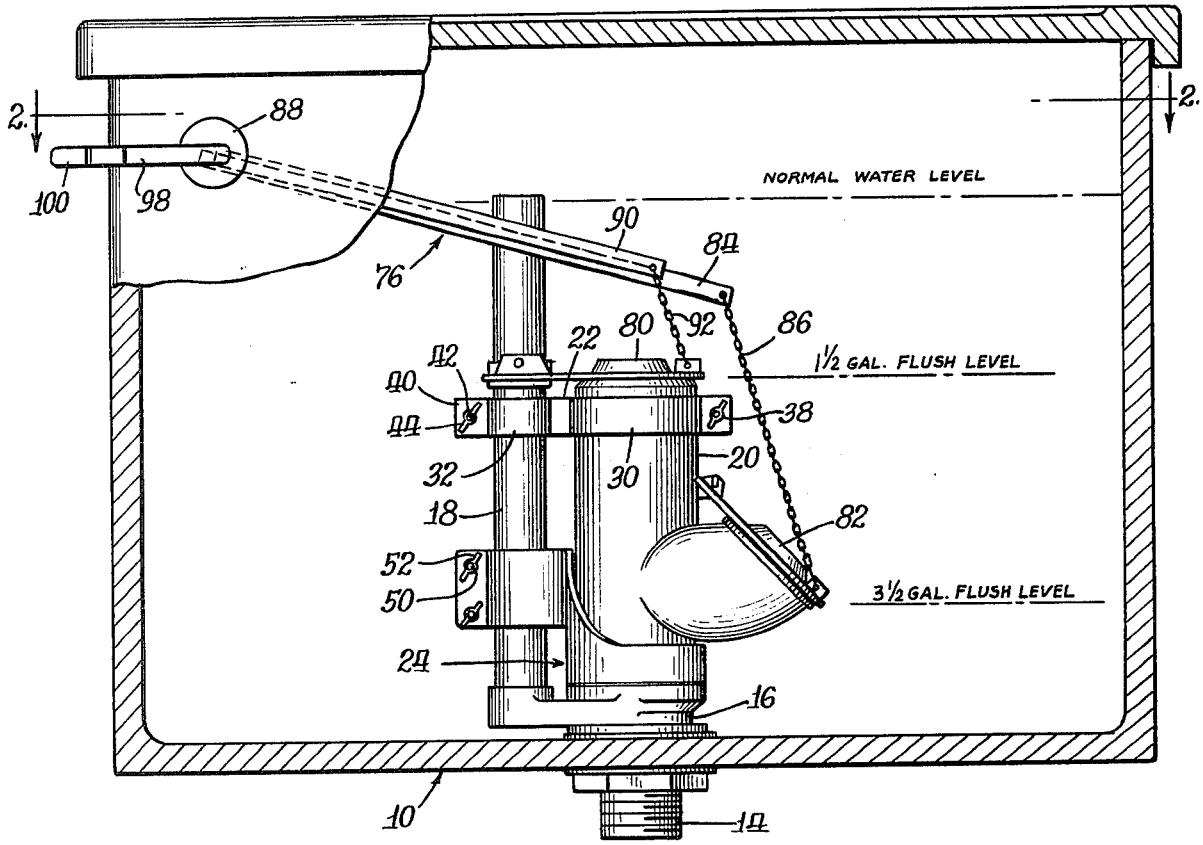
FIG. 1 is a cut-away front view in elevation of a toilet flush tank including a flush valve assembly embodying the invention herein.

Referring now to the drawings wherein like reference characters refer to similar parts 10 illustrates a toilet flush tank in which is mounted a dual flush valve assembly 12 for permitting different amounts of water to be used in the flushing process as desired.

Normally positioned at the center of and extending through the bottom wall of the tank is a drain pipe 14 which is threadedly secured to a drain valve 16 commonly referred to in the plumbing trade as a Douglas valve. An overflow pipe 18 is connected to the drain valve 16 and controls the lever of the water in the flush tank when it is refilled after a flushing operation.

The flush valve assembly 12 as here illustrated comprises a dual flush valve arrangement which may be operated to permit a greater or lesser amount of flushing water to be used as desired. The flush valve assembly 12 comprises a valve body 20 and upper and lower bracket members 22 and 24 which in an installation are connected to the overflow pipe. The valve body 20 is constructed in the form of a tubular member. At the upper end of the valve body there is provided a valve controlled inlet 26, and intermittent the ends of the valve body there is formed an integral intersecting inlet portion open at its outer end to provide another valve controlled inlet 28.

Figure 4:
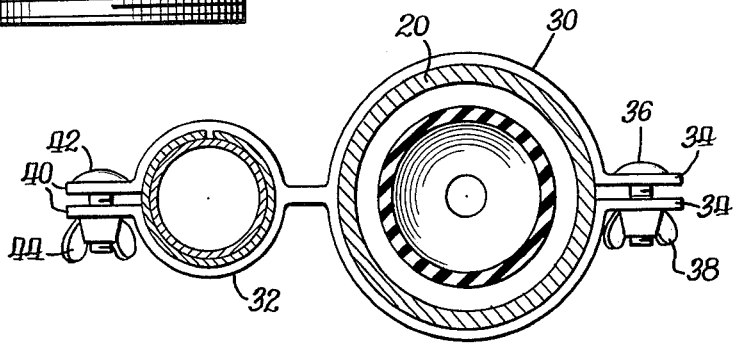
FIG. 4 is a plan view in section taken at line 4—4 of FIG. 3.

The upper bracket member 22 comprises a pair of connected circular collar portions 30 and 32, portion 30 being adapted to encircle the tubular valve body and the other portion 32 being adapted to encircle the overflow pipe 18. The collar portion 30 is split and formed with a pair of ears 34 at its open ends. The ears 34 are adapted to be pressed together with the aid of a bolt and wing nut arrangement 36 and 38 as best seen in FIG. 4. It is apparent that tightening the wing nut 38 will tend to secure the associated collar portion 30 to the valve body. The collar portion 32 also is split and formed with a pair of ears 40 which are adapted to be pressed together with the aid of another bolt and wing nut arrangement 42 and 44. Tightening the wing nut 44 will secure the collar portion 30 to the overflow pipe 18.

The lower bracket member 24 also comprises a split collar portion 46 formed with a pair of ears 48 which are adapted to be pressed together by a bolt and wing nut arrangement 50 and 52 to secure lower bracket member 24 to overflow pipe 18. Spacer bushings 32*a* and 46*a* may be provided in connection with each of the collar portions 32 and 46 to accommodate different sizes of overflow pipes.

Integrally formed with and extending downwardly from the split collar portion 46 is a circular support member 54 which in the assembly receives and supports the lower end of the valve body 20. The circular support member 54 as here illustrated is formed with a central opening 56, and on its upper side there is formed a counterbore 58 to provide a circumferentially extending shoulder 60 which provides a seat for the lower end of the tubular valve body 20. An undercut 62 is formed on the lower end of the valve body 20 to receive an O-ring 64 to provide a seal between the circular support member 54 and the valve body 20. The diameter of the lower end 63 of the valve body 20 just above the undercut on the valve body preferably is of a size to provide a snug fit with the counterbore 58. Other methods of sealingly connecting the lower end of the valve body 20 to the support member 54 may be used.

Figure 3:
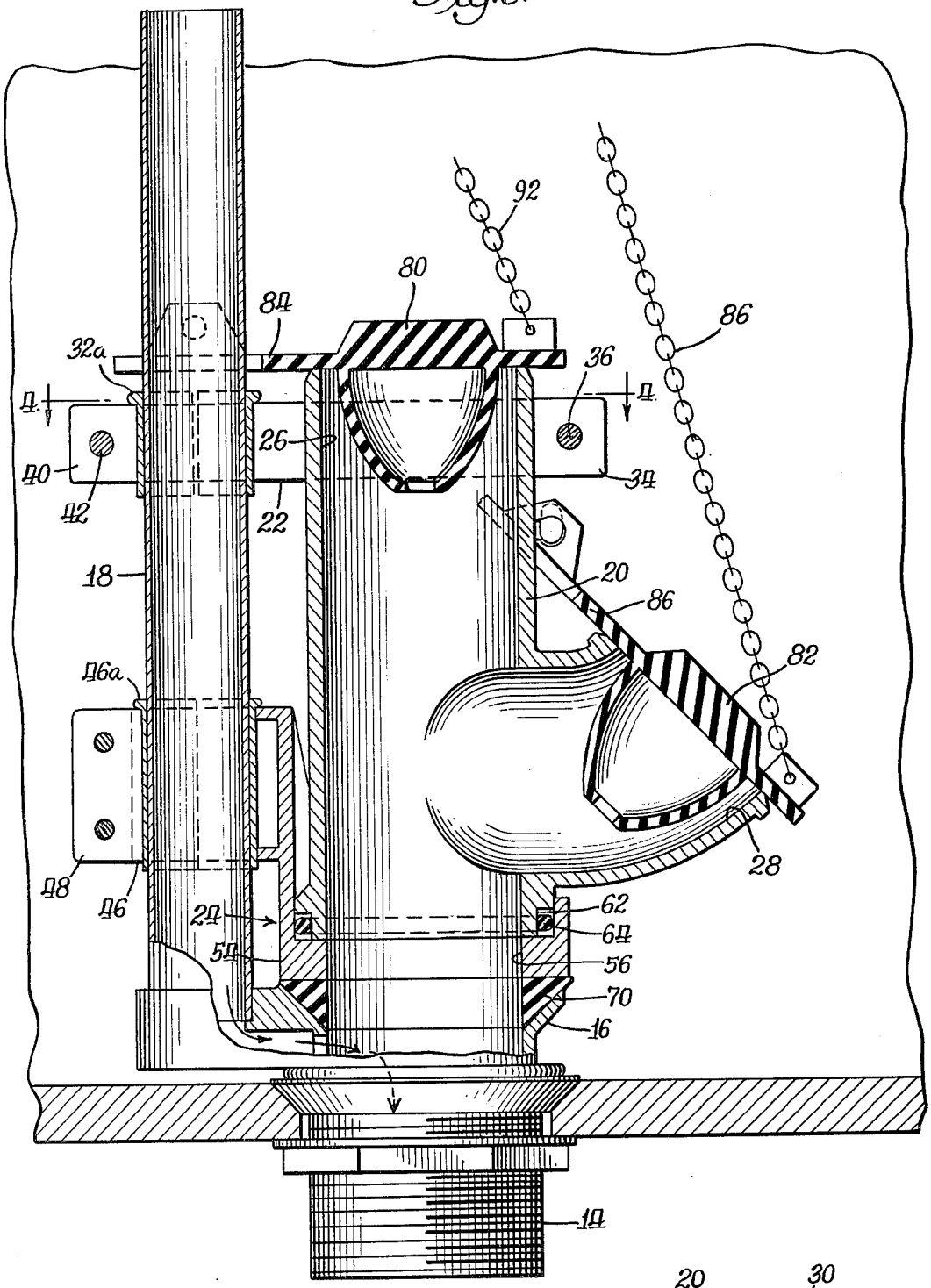
FIG. 3 is an enlarged front view in elevation of a dual flush valve assembly as shown in FIG. 1.

The lower side of support member 54 is formed with a surface 66 which preferably is flat. The outer diameter of the support member's flat lower surface 66 is substantially the same as the diameter of the upper edge 68 of the drain valve 16. If the drain valve is of a type having its inlet face formed at an angle to the horizontal as shown in FIG. 8 instead of lying in a horizontal plane as shown in FIGS. 3 and 7, then the lower side of the support member 54 will require a complimentary surface formed at the same angle to the horizontal.

A gasket 70 preferably of sponge rubber is disposed on gasket seat 72 formed in the drain valve 16. Normally, the gasket seat 72 is conical shaped and the gasket is of a complimentary shape. The upper surface of gasket 70 is flat so that the flat surface 66 on the lower side or underside of support member 54 may seat thereon. During installation of the flush valve assembly into the flush tank, the lower bracket member 24 is squeezed down onto the gasket 70 and the wing nuts 52 are tightened thus leaving a sealed engagement between the lower surface 66 of support member 54 and drain valve 16.

Valve inlets 26 and 28 are normally closed by a pair of flapper valves 80 and 82. The valves 80 and 82 are operated by a selective control assembly 76 which include arm members, intermediate chain connectors and operating handles connected to the arm members.

The valve 80 is operated by the linkage including elongated arm member 90 and chain 92 connected between the arm member 90 and valve 80. The arm member 90 is pivotally supported in mounting 88 secured in the tank wall by a nut 89 as best seen in FIGS. 5 and 6.

The valve 82 is operated by the linkage including elongated arm member 84 and chain 86 connected between the arm member 84 and valve 82. The arm member 84 also is pivotally supported in mounting 88.

Each of the arm members 84 and 90 are formed with portions 84*a* and 90*a* bent at substantially right angles to the main portion of the arms. These portions extend through openings 94 and 96 in the mounting 88 and are secured to handles 98 and 100.

The arm members 84 and 90 here described preferably are of metal and have a rectangular cross-section. It will be observed from FIG. 6 that the openings 94 and 96 are constructed in a shape which will permit the arm members 84 and 90 to pivot by gravity on the lower edge of the portions 84*a* and 90*a*. Operation of the handle 98 in a counterclockwise direction will open the valve 80 to allow only a limited amount of flush water down to the 1½ gallon flush level to be released into the drain pipe. Operation of the handle 100 in a counterclockwise direction will open the valve 82 to allow a full flush by releasing the water in the tank down to the 3½ gallon flush level.

The installation of the assembly may be conveniently carried out as follows. We start from the point where the drain valve and overflow pipe are already installed in the tank. The gasket 70 is placed in position on its seat 72 surrounding the drain valve inlet. The lower bracket member 24 is then slipped onto the overflow pipe and accurately squeezed down onto the gasket 70 on the drain valve at which point the wing nuts 52 on the collar 46 are tightened leaving the bracket member 24 in tight sealing engagement with the drain valve. Then the uper bracket member 22 with the valve body 20 loosely attached thereto is fitted over the overflow pipe 18. Then the lower end of the valve body is fitted into support member 54. At this time, the valve body can be rotated about its vertical axis to any desired position regardless of the position of the drain valve 16.

Figure 2:
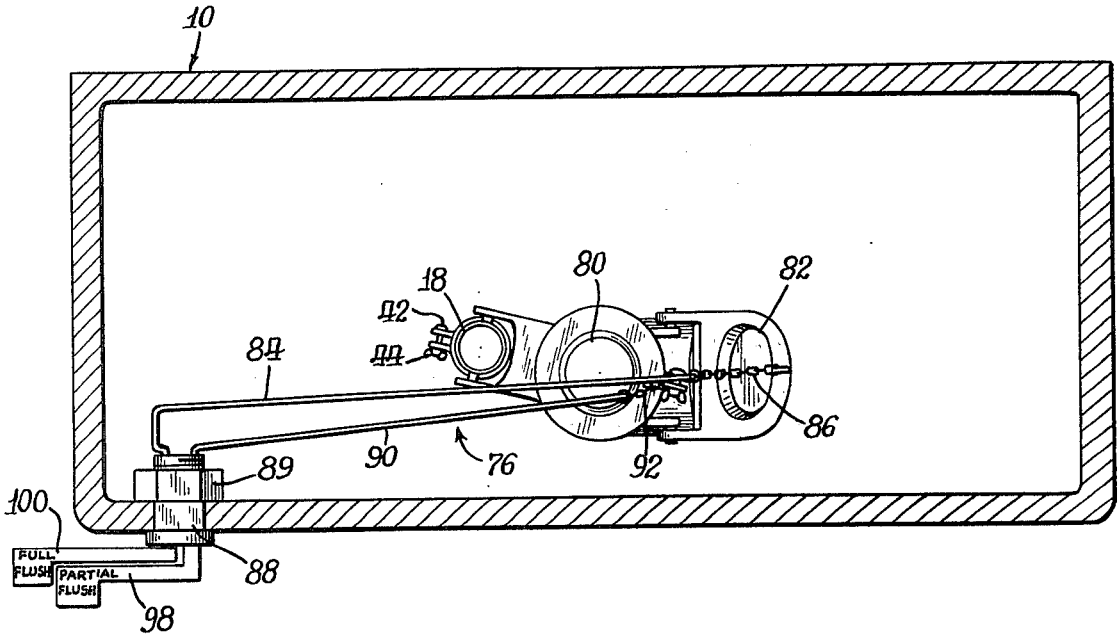
FIG. 2 is a plan view of the flush tank of FIG. 1 taken along line 2—2 of FIG. 1.

The already installed drain valve in existing installations may be found in any number of different positions as illustrated by way of example in the various dotted line positions of the drain valve shown in FIG. 9. Because the valve body 20 is entirely independent of the two bracket members 22 and 24 it conveniently can be rotated to any desired position including the position shown in FIG. 2. Once the valve body is accurately positioned, the upper bracket member 22 is secured to the valve body and overflow pipe.

When the upper and lower brackets 22 and 24 are loosened, the assembly may be swung around in a horizontal plane about the axis of the overflow pipe 18. In the event that replacement of the V-shaped gasket is required it is necessary only to loosen the upper and lower brackets by loosening the wing nuts securing them to the overflow pipe and swinging the valve assembly around the axis of the overflow pipe thus leaving the gasket 70 exposed and available to be removed from its seat for replacement. This is another important feature from the standpoint of ease and convenience in servicing the assembly.

It must be remembered that an important aspect of the invention herein is to provide a flush valve assembly which is easily installed or replaced without the use of special tools and without the assistance of a plumber. We are here looking at a money saving device, i.e., an item that will be important to help in the conservation of water. Without this attraction of easy installation, however, many people might well pass up the opportunity to contribute to the conservation program.

It will be apparent that I have advantageously provided an easily installable flush valve assembly which can be accommodated to existing flush tank installations. Very few tools, if any, are required, and it is apparent that vital parts such as gaskets and seals are easily replaceable by the average person without resorting to expensive plumber help. The parts are simple and easily manufactured. The valve body and bracket members preferably are made of a plastic material and may conveniently be made by the injection molding process.

While certain embodiments of the invention have been specifically disclosed, it is to be understood that the invention is not limited thereto as other variations will be apparent to those skilled in the art, and the invention is to be given its fullest possible interpretation within the terms of the following claims.

What is claimed is:

1. A flush valve assembly for a toilet tank having a drain valve positioned in the bottom wall thereof and an overflow pipe connected to the drain valve comprising:
   - an elongated valve body;
   - inlet means formed in said valve body;
   - valve means for controlling the opening and closing of said inlet means;
   - an upper bracket member associated with said valve body and including means for connecting said bracket member to the overflow pipe;
   - a second lower bracket member associated with said valve body;
   - said second bracket member having first and second portions, said first portion including means for attaching said bracket member to the overflow pipe and said second portion including means for attaching to and supporting said valve body;
   - means defining an opening through said second portion of said second bracket member for establishing flush communication between said valve body and the drain valve;
   - cooperating means on the upper side of said second bracket member and the lower end of said valve body for effecting a sealing engagement therebetween;

means defining a lower face portion on the underside of said second bracket member adapted to be positioned on the drain valve.

2. The flush valve assembly of claim 1 wherein said valve means operably connected to said valve body include two flush valves;

a first flush valve located at the upper end of the valve body whereby when it is opened only a relatively small portion of the water in the flush tank will be discharged, and a second flush valve disposed intermediate the ends of said valve body whereby when it is opened a relatively large portion of the water in the flush tank will be discharged.

3. The flush valve assembly of claim 1 wherein both of said bracket members are discrete members non integral with said valve body whereby said valve body can be rotated to different positions to facilitate installation of the flush valve assembly.

4. The flush valve assembly of claim 1 wherein said cooperating means for effecting a sealing engagement between said valve body and said second portion of said second bracket member comprises an O-ring disposed between the lower end of said valve body and said second portion of said second bracket member.

5. The flush valve assembly of claim 1 wherein said cooperating means for effecting a sealing engagement between said valve body and said second portion of said second bracket member comprises an O-ring disposed on the lower end of said valve body.

6. The flush valve assembly of claim 1 wherein said valve means include two flush valves for controlling two inlets formed in said valve body, and further including a selective control assembly mounted on the toilet tank and connected to said two flush valves for selectively operating said two flush valves.

7. The flush valve assembly of claim 1 including means for releasably connecting said bracket members to the overflow pipe whereby said bracket members may be loosened to move the valve body and bracket members as a unit from a seated position on the drain valve to a non-seating position and vice-versa to permit easy removal and replacement of a gasket member occupying a position between said lower bracket member and the drain pipe.

8. The flush valve assembly of claim 1 including gasket means for effecting a sealing engagement between said lower face portion on said second bracket member and the drain valve.

* * * * *